US007770404B2

(12) United States Patent
An et al.

(10) Patent No.: US 7,770,404 B2
(45) Date of Patent: Aug. 10, 2010

(54) ICE MAKING SYSTEM FOR REFRIGERATOR

(75) Inventors: Si-Yeon An, Gyeongsangnam-Do (KR); Seong-Wook Kim, Gyeongsangnam-Do (KR); Hyung-Kyu Park, Gyeongsangnam-Do (KR); Young-Sin Park, Gyeongsangnam-Do (KR); Wook-Yong Lee, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 602 days.

(21) Appl. No.: 11/727,603

(22) Filed: Mar. 27, 2007

(65) Prior Publication Data

US 2007/0220909 A1 Sep. 27, 2007

(30) Foreign Application Priority Data

Mar. 27, 2006 (KR) ..... 10-2006-0027254
Sep. 7, 2006 (KR) ..... 10-2006-0086376

(51) Int. Cl.
*F25C 1/00* (2006.01)

(52) U.S. Cl. ..... 62/137; 62/135; 62/131; 62/344

(58) Field of Classification Search ..... 62/131, 62/135, 137, 344
See application file for complete search history.

(56) References Cited

U.S. PATENT DOCUMENTS 3,832,914 A * 9/1974 Pinfield ..... 74/810.1
4,835,978 A * 6/1989 Cole ..... 62/137
2003/0010053 A1 1/2003 Kim et al.
2005/0257536 A1 * 11/2005 Chung et al. ..... 62/135

FOREIGN PATENT DOCUMENTS

EP 1598617 11/2005
KR 1020060029864 4/2006

* cited by examiner

*Primary Examiner*—Frantz F. Jules
*Assistant Examiner*—Jonathan Bradford
(74) *Attorney, Agent, or Firm*—Ked & Associates LLP

(57) ABSTRACT

An ice making system for a refrigerator is provided. The ice making system includes an ice maker body, an ejector rotatably coupled to the ice maker body that drops ice pieces made by the ice maker body, an ice bank drawably disposed below the ice maker body that stores the ice pieces dropped by the ejector, an ice sensing lever that senses an amount of the ice pieces stored in the ice bank, a lever holding device that elastically supports and couples the ice sensing lever, and a driving force transmitting device that transmits a rotation force received from the ejector to the lever holding device, thereby rotating the lever holding device. The ice sensing lever may move within a predetermined range when an external force is applied to the ice sensing lever.

12 Claims, 8 Drawing Sheets

ICE MAKING SYSTEM FOR REFRIGERATOR

RELATED APPLICATION

The present disclosure relates to subject matter contained in priority Korean Application No. 10-2006-0027254, filed on Mar. 27, 2006 and No. 10-2006-0086376, filed on Sep. 7, 2006, which are herein expressly incorporated by reference in its entirety.

BACKGROUND OF THE INVENTION

1. Field of the Invention

The present invention relates to a refrigerator, and more particularly, to an ice making system for a refrigerator.

2. Description of the Background Art

Generally, a refrigerator serves to store food items such as meat, fish, vegetable, fruit, beverage, etc. with a fresh state. The refrigerator includes a body having a freezing chamber, a cooling chamber, a vegetable chamber, etc., and a door provided at one side of the body for opening and closing the freezing chamber and the cooling chamber.

The body includes a refrigerating cycle apparatus having a compressor, a condenser, a capillary tube, an evaporator, etc., a blowing fan for forcibly blowing cool air generated by the evaporator, and a circulation path for guiding cool air generated by the evaporator to be introduced into the evaporator via the freezing chamber and the cooling chamber.

When the temperature of the freezing chamber or the cooling chamber is increased by a predetermined degree, the refrigerating cycle apparatus is operated. As the refrigerating cycle apparatus is operated, cool air is generated by the evaporator. Then, the cool air circulates the freezing chamber and the cooling chamber by the blowing fan. Accordingly, the freezing chamber, the cooling chamber, and the vegetable chamber provided at the cooling chamber maintain each preset temperature.

The refrigerator is classified into various types according to a method for circulating cool air, each position of the freezing chamber and the cooling chamber, and a configuration of the evaporator.

For instance, the refrigerator includes a refrigerator in which the freezing chamber is disposed above the cooling chamber, a refrigerator in which the freezing chamber and the cooling chamber are disposed in parallel with each other, a refrigerator in which the freezing chamber is disposed below the cooling chamber.

The size of the refrigerator is being increased according to a user's demand, and various functions are implemented so as to enhance the user's convenience.

As one example, the door is provided with a home bar by which beverage, etc. stored in the cooling chamber can be taken out without opening the door.

Also, the door is provided with a dispenser by which water or ice can be taken out without opening the door.

The refrigerator having the dispenser includes an ice maker for making ice, and an ice bank for storing ice pieces made by the ice maker. In order to use ice pieces stored in the ice bank, a user has to draw out the ice bank and then mount the ice bank below the ice maker.

When ice pieces made by the ice maker are stored in the ice bank, an amount of the ice pieces stored in the ice bank has to be precisely measured. If the amount of the ice pieces stored in the ice bank is not precisely measured, the ice pieces made by the ice maker are excessively supplied to the ice bank thus to overflow from the ice bank.

Furthermore, when a user mounts the ice bank below the ice maker, the ice bank and other components may be damaged by colliding with one another.

SUMMARY OF THE INVENTION

Therefore, an object of the present invention is to provide an ice making system for a refrigerator capable of preventing an ice bank for storing ice pieces made by an ice maker from being damaged by colliding with other components, and capable of precisely measuring an amount of the ice pieces stored in the ice bank.

To achieve these and other advantages and in accordance with the purpose of the present invention, as embodied and broadly described herein, there is provided an ice making system for a refrigerator, comprising: an ice maker body; an ejector rotatably coupled to the ice maker body, for dropping ice pieces made by the ice maker body; an ice bank drawably disposed below the ice maker body, for storing the ice pieces dropped by the ejector; an ice sensing lever for sensing an amount of the ice pieces stored in the ice bank; a lever holding unit for elastically supporting and coupling the ice sensing lever so that the ice sensing lever can move within a predetermined range when an external force is applied to the ice sensing lever; and a driving force transmitting unit for transmitting a rotation force received from the ejector to the lever holding unit thereby rotating the lever holding unit.

According to another aspect of the present invention, there is provided an ice making system for a refrigerator, comprising: an ice maker disposed in a refrigerator for making ice; an ice bank for storing the ice pieces made by the ice maker; an ice sensing lever for sensing an amount of the ice pieces stored in the ice bank; a lever holding unit for elastically supporting and coupling the ice sensing lever so that the ice sensing lever can move within a predetermined range when an external force is applied to the ice sensing lever; and a driving unit for rotating the lever holding unit.

According to still another aspect of the present invention, there is provided an ice making system for a refrigerator, comprising: an ice maker disposed in a refrigerator for making ice; an ice bank for storing the ice pieces made by the ice maker; an ice sensing lever rotated in the ice bank; and an ice sensing plate provided at the ice sensing lever and rotated together with the ice sensing lever, for sensing an amount of the ice pieces stored in the ice bank.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, an ice making system for a refrigerator according to the present invention will be explained with reference to the attached drawings.

Figure 1:
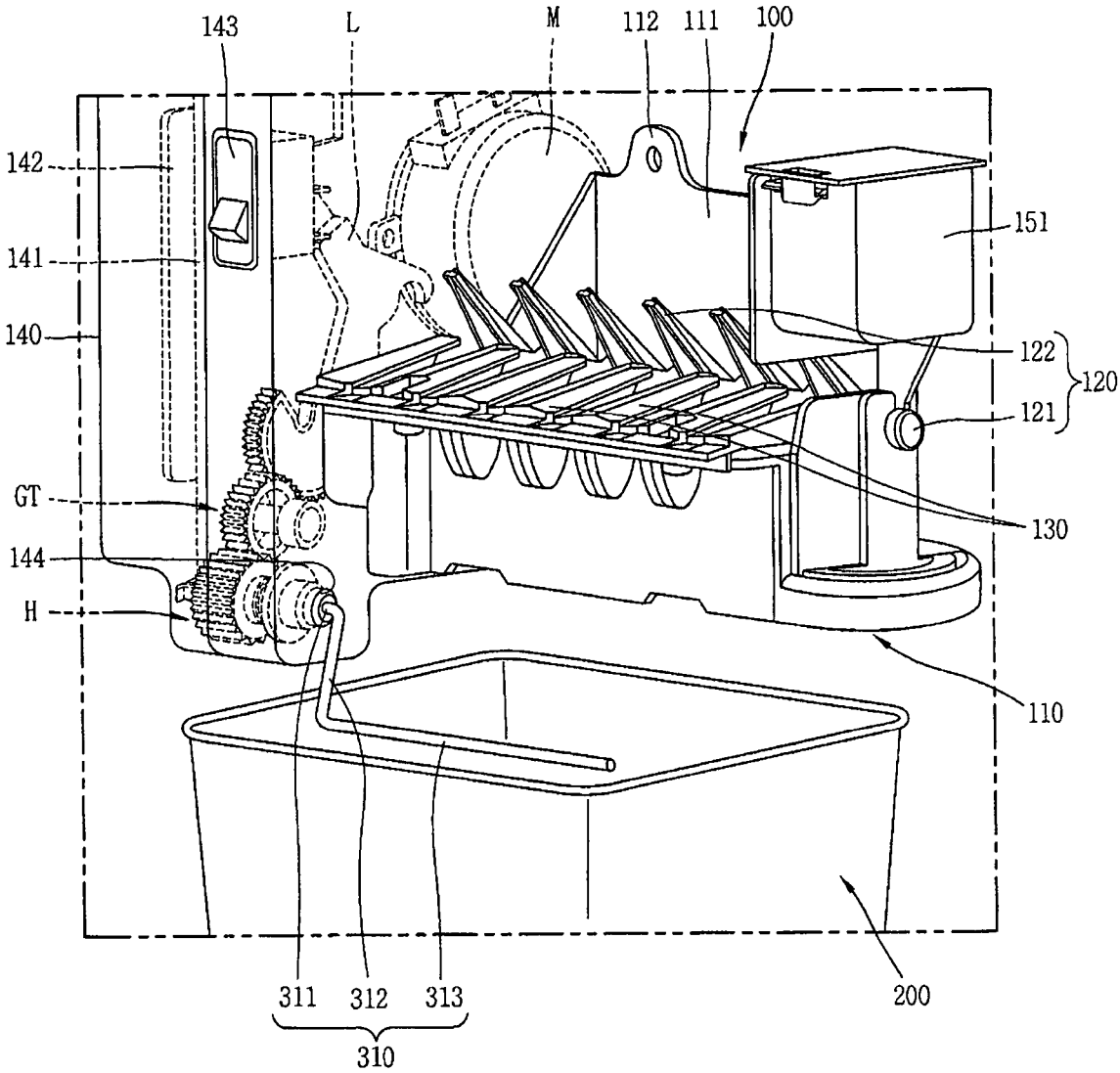
FIG. 1 is a perspective view showing an ice making system for a refrigerator according to a first embodiment of the present invention.

FIG. 1 is a perspective view showing an ice making system for a refrigerator according to a first embodiment of the present invention.

As shown, the ice making system for a refrigerator comprises an ice maker 100 disposed in a refrigerator, and an ice bank 200 detachably mounted below the ice maker 100 for storing ice pieces.

The ice maker 100 includes an ice maker body 110 having a predetermined length; an ejector 120 for ejecting ice pieces made by the ice maker body 110 into the ice bank 200, a stripper 130 for guiding the ice pieces ejected by the ejector 120 to be dropped into the ice bank 200; a water supplying unit for supplying water into the ice maker body 110; and a housing 140 disposed at a lateral side of the ice maker body 110, and having a controlling unit, a driving force generating unit, etc, therein.

An ice tray (not shown) for forming a plurality of ice pieces is disposed in the ice maker body 110, and a base plate 111 having a predetermined area is disposed at one side of the ice maker body 110. Water supplied from the water supplying unit is contained in the ice tray, and then is frozen thus to form ice. A mounting portion 112 is disposed at one side of the base plate 111, and is mounted at an inner wall of the refrigerator.

The ejector 120 includes an ejector shaft 121 rotatably coupled to the ice maker body 110 and connected to the driving force generating unit, and a plurality of ejector fins fixedly-coupled to the ejector shaft 121 with a predetermined gap. The ejector 120 is disposed above the ice tray.

The stripper 130 has a predetermined width and length, and is disposed to be inclined at the ice maker body 110 with a predetermined gap. Each ejector fin 122 is disposed between the strippers 130.

As the ejector shaft 121 is rotated, the ejector fins 122 are together rotated thus to dispose ice pieces made in the ice tray onto the strippers 130. Then, the ice pieces disposed on the strippers 130 are slid thus to be dropped into the ice bank 200.

The water supplying unit includes a water supplying hopper 151 mounted at one side of the ice maker body 110, and a water supplying tube (not shown) for connecting the water supplying hopper and a water supplying source with each other.

The water supplying hopper 151 is disposed above the ice tray, and the water supplying hopper 151 provides water supplied from the water supplying source to the ice tray.

The housing 140 is coupled to one side of the ice maker body 110 so as to be positioned at an opposite side to the water supplying hopper 151. The housing 140 may be integrally formed with the ice maker body 110, or may be coupled to the ice maker body 110 after being formed of a different material from the ice maker body 110.

A fixing plate 141 is disposed in the housing 140. A driving force generating unit for generating a driving force, and a driving force transmitting unit for transmitting a driving force to another component are mounted at the fixing plate 141.

Preferably, the driving force generating unit is implemented as a motor M mounted at the fixing plate 141 and generating a rotation force.

As one example, the driving force transmitting unit includes a gear train GT to which a plurality of gears are connected, and a lever L connected to the gear train GT. The lever L is connected to the ejector 120, and a gear portion formed at one side of the lever L is connected to the gear train GT. The motor M is connected to the ejector 120, and a magnet (not shown) is disposed at one side of the lever L.

A printed circuit board 142 having electric components including a hole sensor is mounted in the housing 140. A part of the electric components constitutes a controlling unit. A switch 143 for turning on/off the ice maker is mounted at one side of the housing 140.

The lever holding unit H is disposed in the housing 140 so as to be connected to the gear train GT.

Figure 2:
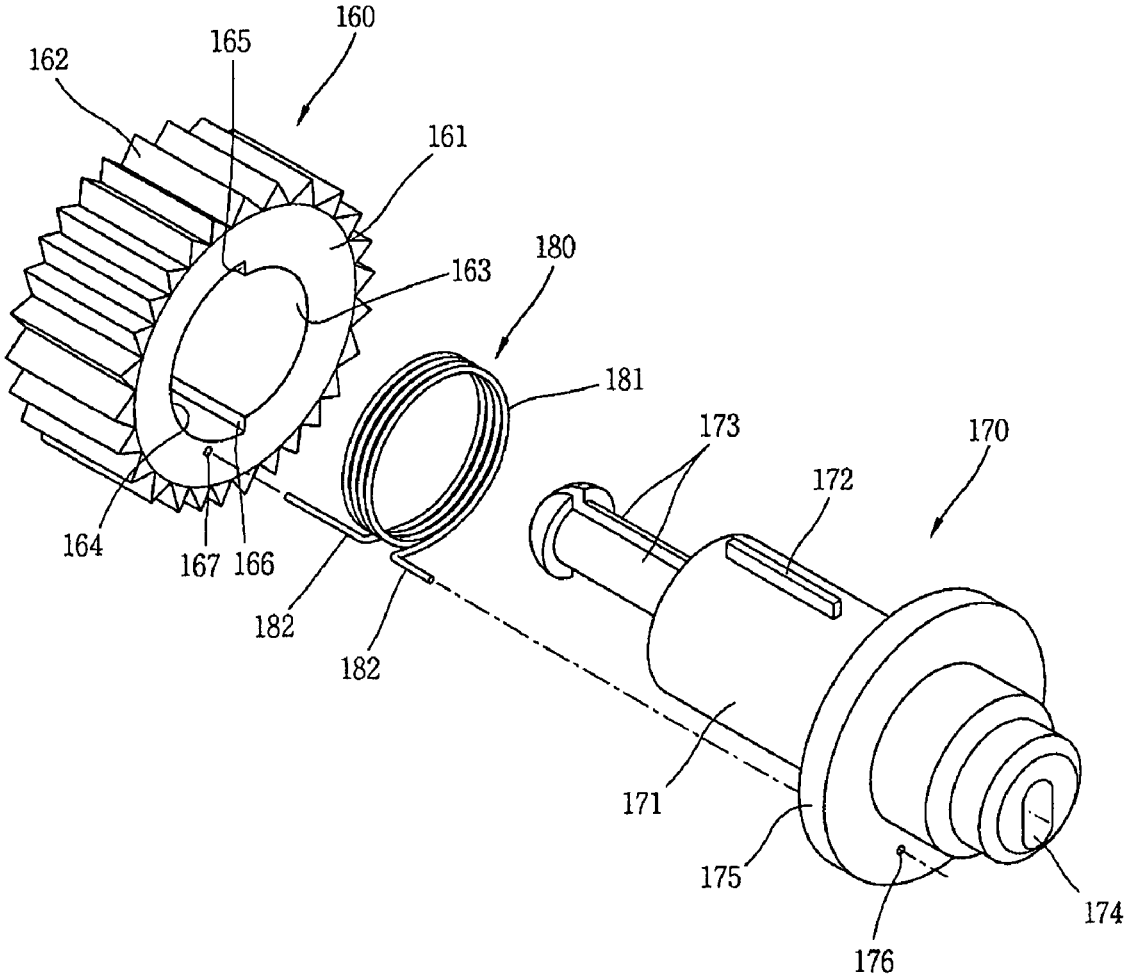
FIG. 2 is an exploded perspective view showing a lever holding unit of the ice making system for a refrigerator.
Figure 3:
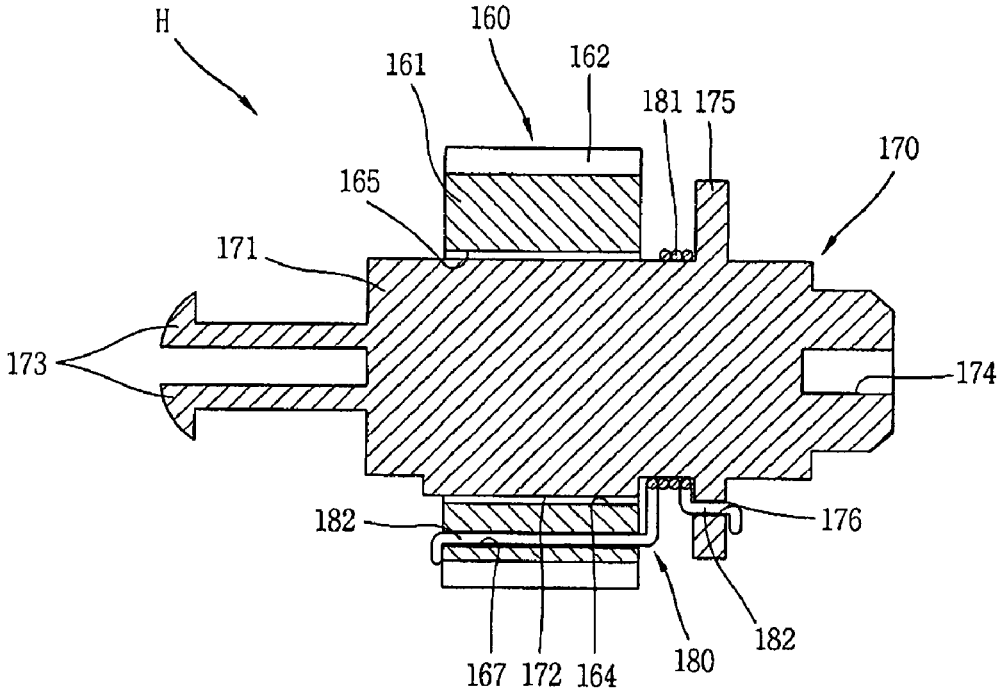
FIGS. 3 and 4 are front and side sectional views of the lever holding unit, respectively.
Figure 4:
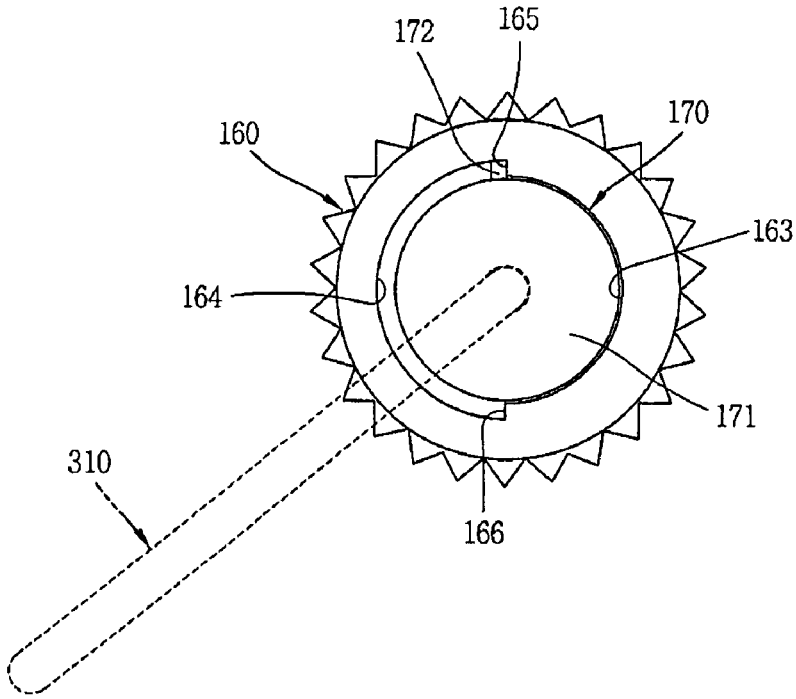

As shown in FIGS. 2, 3 and 4, the lever holding unit H includes a gear member 160 connected to the gear train GT, a holder 170 inserted into the gear member 160 so as to be movable within a predetermined range, and an elastic member 180 for elastically connecting the holder 170 and the gear member 160 with each other.

The gear member 160 includes a body 161 having a bar shape of a predetermined length, gear teeth 162 disposed on an outer circumferential surface of the body 161, a through hole 163 penetratingly formed in the body 161, and a guiding groove 164 formed at an inner circumferential surface of the through hole 163 with a predetermined depth. The guiding groove 164 is formed within an approximate range of 180° in a circumferential direction, and is provided with a first stepped portion 165 and a second stepped portion 166 at both ends thereof.

The holder 170 includes a cylindrical portion 171 having a bar shape of a predetermined length, a stopping protrusion 172 protruding from an outer circumferential surface of the cylindrical portion 171 with a predetermined width and length, a hook portion 173 extending from one side of the cylindrical portion 171, a fixing hole 174 formed at another side of the cylindrical portion 171 with a predetermined depth, and a stopper 175 formed at one side of the cylindrical portion 171 with a predetermined thickness and height and having a ring shape. An outer diameter of the cylindrical portion 171 corresponds to an inner diameter of the through hole 163, and a height of the stopping protrusion 172 corresponds to a depth of the guiding groove 164 of the gear member 160.

The hook portion 173 is composed of two hooks having each elastic force.

The cylindrical portion 171 of the holder 170 is inserted into the through hole 163 of the gear member 160, and the stopping protrusion 172 is disposed at the guiding groove 164. Herein, one surface of the stopper 175 of the holder 170 faces one surface of the gear member 160, and the hook portion 173 of the holder 170 is protruding outside the gear member 160.

Preferably, the elastic member 180 is a torsion spring. The torsion spring includes a turn portion 181 on which a wire is wound many times, and fixing portions 182 straightly extending from both ends of the turn portion 181. The fixing portions 182 are preferably disposed on the same line when an external force is not applied thereto.

The cylindrical portion 171 of the holder 170 is inserted into the turn portion 181 of the torsion spring, one fixing portion 182 is inserted into a pin hole 167 formed at one surface of the gear member 160, and another fixing portion 182 is inserted into a pin hole 176 formed at the stopper 175 of the holder 170.

Under a state that the gear member 160, the torsion spring 180 and the holder 170 are coupled to one another, the stopping protrusion 172 of the holder 170 is supported at the first stepped portion 165 by an elastic force of the torsion spring 180. When a torque is applied to the holder 170 towards the second stepped portion 166 of the gear member 160 under a state that the gear member 160 is in a fixed state, the holder 170 receives an elastic force by the torsion spring 180 thus to be angle-rotated. Then, if the torque applied to the holder 170 is removed, the holder 170 is angle-rotated in a reverse direction by a restoration force of the torsion spring 180. Accordingly, the stopping protrusion 172 of the holder 170 is locked by the first stepped portion 165 of the gear member 160. Herein, the holder 170 can be movable up to the second stepped portion 166.

Under a state that the gear member 160, the torsion spring 180 and the holder 170 are coupled to one another, the gear teeth 162 of the gear member 160 are engaged with the gears of the gear train GT. Under this state, the hook portion 173 of the holder 170 is inserted into a through hole (not shown) of the fixing plate 141, and one side of the holder 170 is inserted into through holes 144 formed at the housing 140. The hook portion 173 of the holder 170 is inserted into the through hole of the fixing plate 141 thus to be prevented from being separated therefrom. Under a state that the holder 170 has been inserted into the through hole 144 of the housing 140, one end of the holder 170 is protruding to outside the housing 140 and the fixing hole 174 formed at the end is exposed to outside of the housing 140.

When the gears of the gear train GT are rotated, the rotation force is transmitted to the gear teeth 162 of the gear member 160 thus to rotate the gear member 160. As the result, the lever holding unit H is rotated.

An ice sensing lever 310 for sensing an amount of the ice pieces stored in the ice bank 200 is coupled to the lever holding unit H.

As one example, the ice sensing lever 310 is formed as a wire is curved with a multi-step. The wire includes a coupling portion 311 having a predetermined length and fixedly-coupled to the holder fixing hole 174 of the lever holding unit H, a perpendicular portion 312 curvedly-extending from the coupling portion 311 with a predetermined length, and a measuring portion 313 curvedly-extending from the perpendicular portion 312 with a predetermined length.

Under a state that the coupling portion 311 of the ice sensing lever 310 has been coupled to the holder fixing hole 174 of the lever holding unit H, the measuring portion 313 is disposed in the same direction to the ejector shaft 121. Only one side of the ice sensing lever 310 is fixed to the lever holding unit H.

As the lever holding unit H is rotated, the measuring portion 313 of the ice sensing lever 310 is angle-rotated centering around the coupling portion 311 thus to measure an amount of the ice pieces contained in the ice bank 200.

Figure 5:
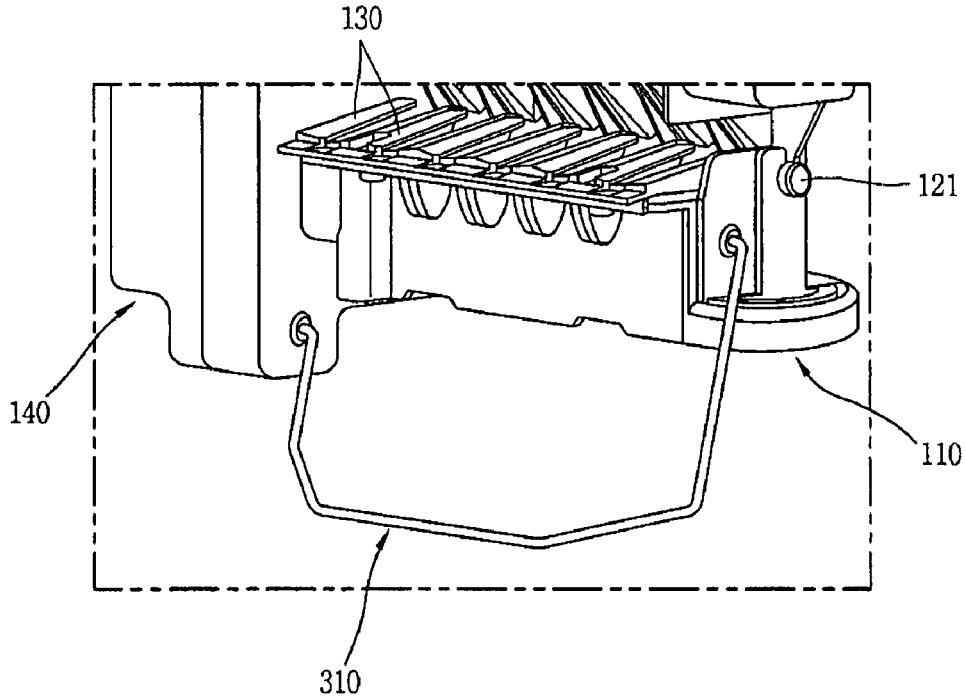
FIG. 5 is a perspective view showing an ice sensing lever of the ice making system for a refrigerator according to a second embodiment of the present invention.

As shown in FIG. 5 according to another embodiment, the ice sensing lever 310 is implemented as a wire having a polygonal shape. One side of the ice sensing lever 310 is fixedly-coupled to the holder fixing hole 174 of the lever holding unit H, and another side thereof is rotatably coupled to one side of the ice maker body 110.

As the lever holding unit H is rotated, a middle part of the ice sensing lever 310 is angle-rotated in the ice bank 200 with making both ends of the ice sensing lever 310 as a reference shaft, thereby measuring an amount of the ice pieces contained in the ice bank 200.

Figure 6:
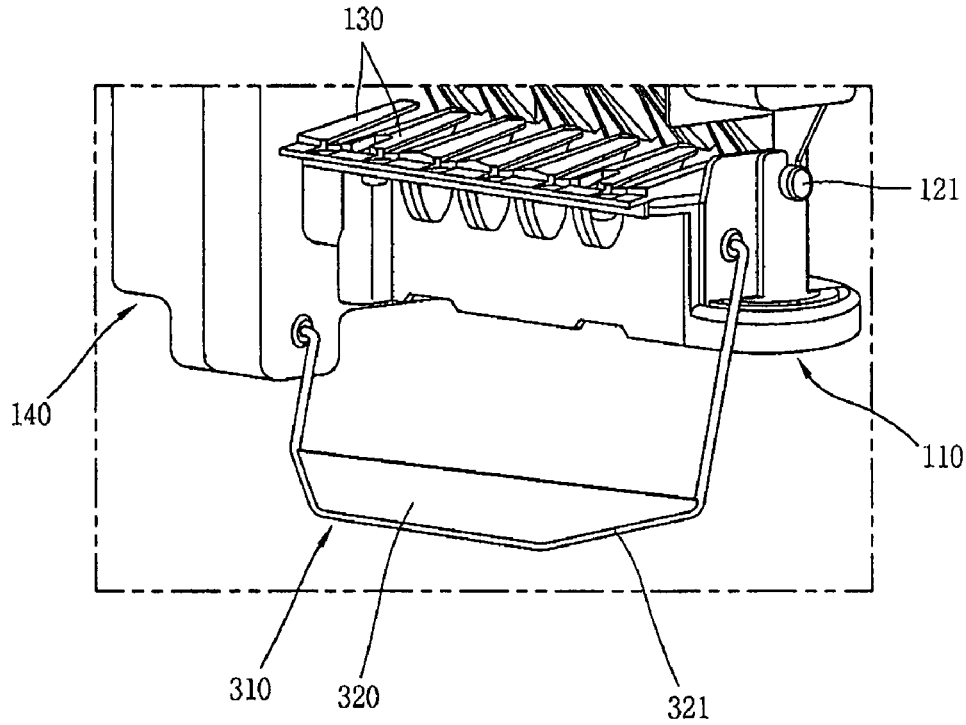
FIG. 6 is a perspective view showing the ice sensing lever and an ice sensing plate.

In order to more precisely measure the ice pieces contained in the ice bank 200, as shown in FIG. 6, an ice sensing plate 320 having a predetermined area is coupled to the ice sensing lever 310.

The ice sensing plate 320 is formed to have a predetermined thickness and area, and is detachably coupled to the ice sensing lever 310. A groove 321 is detachably disposed at the ice sensing lever 310 formed of the wire at a side surface of the ice sensing plate.

The ice sensing plate 320 may be integrally formed with the ice sensing lever 310.

When the ice sensing plate 320 is coupled to the ice sensing lever 310, it measures an amount of the ice pieces contained in the ice bank 200. Accordingly, the amount of the ice pieces can be more precisely measured.

Hereinafter, an operation of the ice making system for a refrigerator according to the present invention will be explained.

The ice making system for a refrigerator according to the present invention may be installed inside a freezing chamber or at a door of the freezing chamber.

Once water is contained in the ice tray of the ice maker body 110 through the water supplying unit, the water is frozen by cool air supplied to the freezing chamber.

As the result, the driving force generating unit generates a rotation force by the controlling unit. The rotation force is transmitted to the ejector 120 and the ice sensing lever 310 through the driving force transmitting unit. As the ice sensing lever 310 is moved together with the ejector 120, it measures the amount of the ice pieces contained in the ice bank 200. At the same time, the ejector 120 ejects the frozen ice pieces in the ice tray to the ice bank 200.

The ice pieces in the ice tray are dropped into the ice bank 200 as follows.

Figure 7:
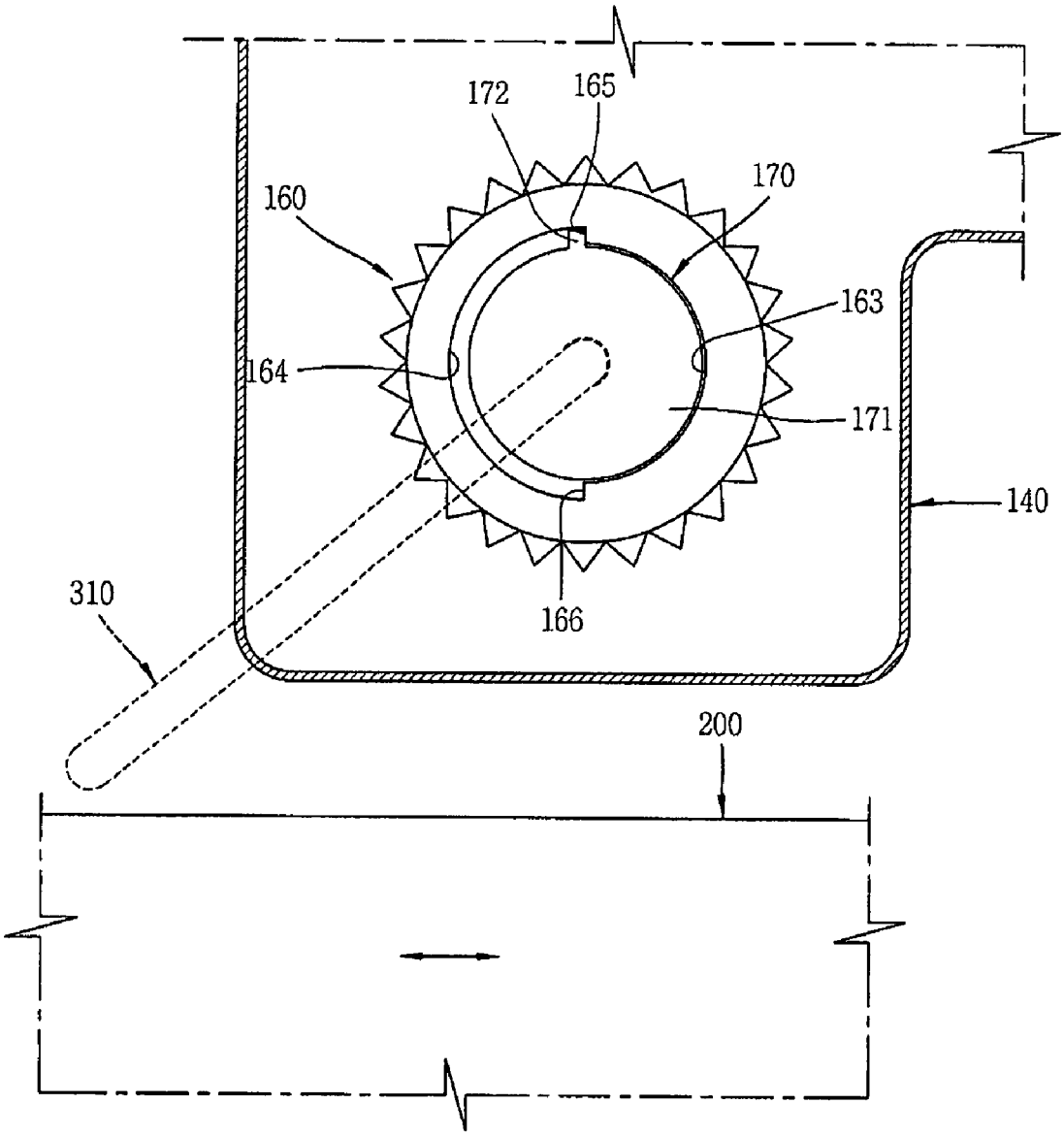
FIGS. 7, 8, 9 and 10 are side sectional views showing an operation state of the ice making system for a refrigerator, respectively.

As shown in FIG. 7, the ice sensing lever 310 is initially positioned in an inclined state based on a perpendicular direction. The ice bank 200 is disposed below the ice maker body 110 or is drawn out by being horizontally moved.

Figure 8:
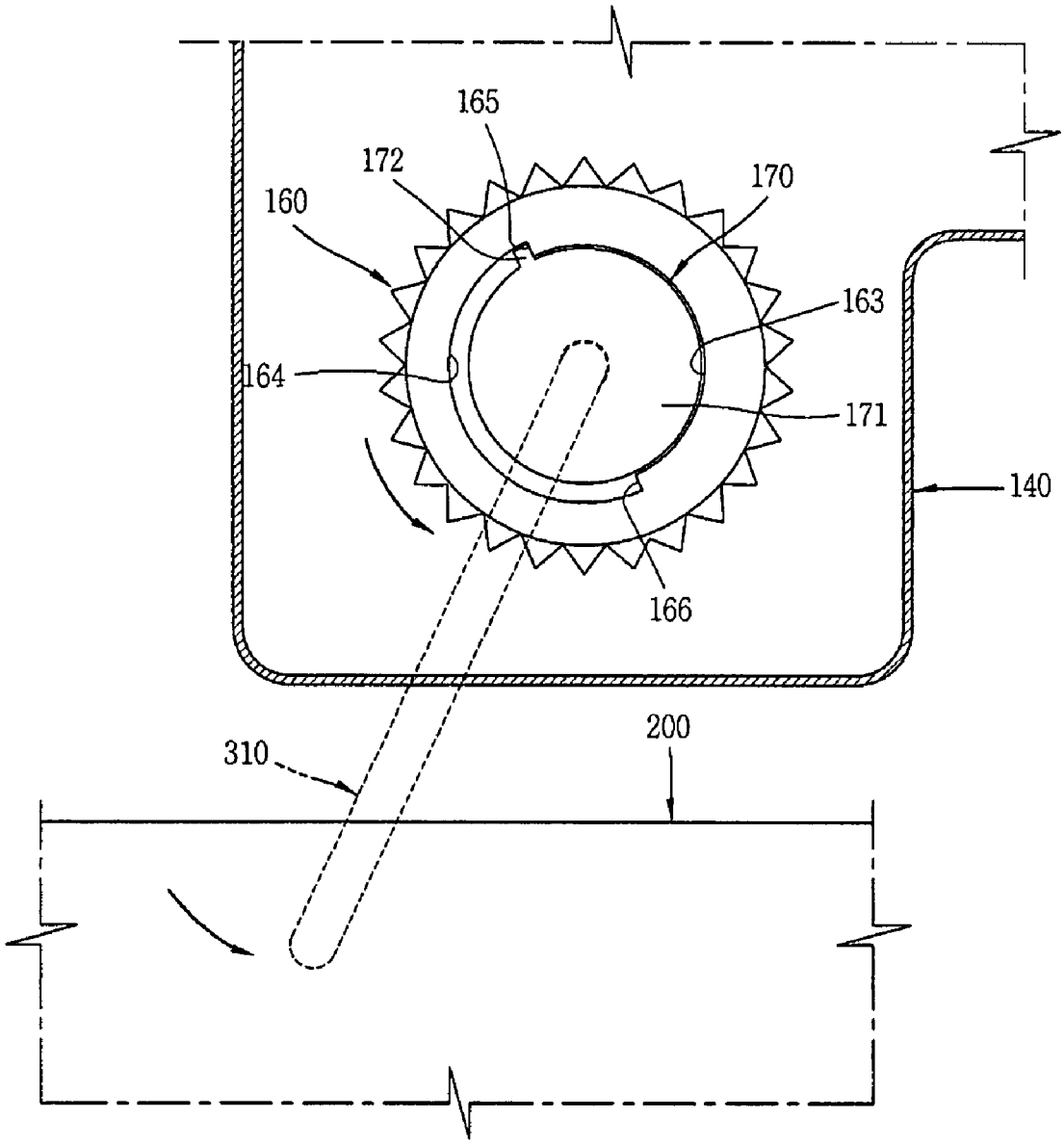

At the time of the initial state of the ice sensing lever 310, the holder 170 of the lever holding unit H is adhered to the gear member 160 by an elastic force of the torsion spring 180. As the ejector shaft 121 is rotated, the lever holding unit H and the ice sensing lever 310 are moved. As shown in FIG. 8, if the ice pieces stored in the ice bank 200 are not locked to the ice sensing lever 310 being angle-rotated, the ejector shaft 121 is continuously rotated. Accordingly, the ejector fins 122 coupled to the ejector shaft eject the ice pieces in the ice tray thus to position on the stripper 130. Then, the ice pieces on the stripper 130 are dropped into the ice bank 200 by being slid. A heater (not shown) is provided at the ice maker body 110, by which the ice pieces are easily separated from the ice tray.

If the amount of the ice pieces contained in the ice bank 200 is more than a preset amount, the ice pieces are locked to the ice sensing lever 310 being angle-rotated in the ice bank 200. As the result, the lever L of the driving force transmitting unit is not rotated up to a preset position.

Since a magnetic force of a magnet provided at the lever L is not sensed by the hole sensor of the printed circuit board 142, the driving force generating unit, the motor M is stopped. As the motor M is stopped, the ejector 120 is stopped and thus the ice pieces made in the ice tray are not stored in the ice bank 200.

Figure 9:
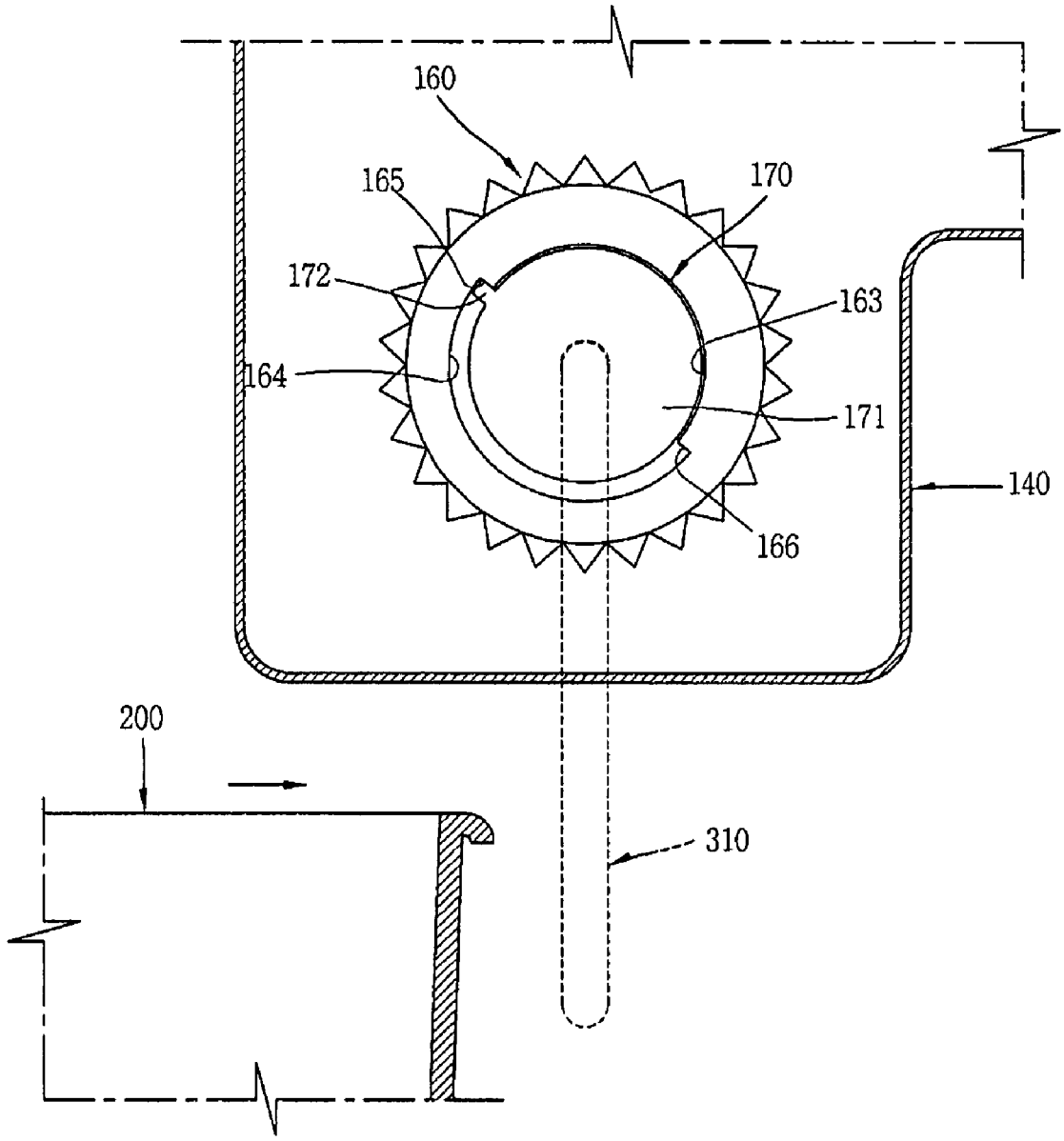
Figure 10:
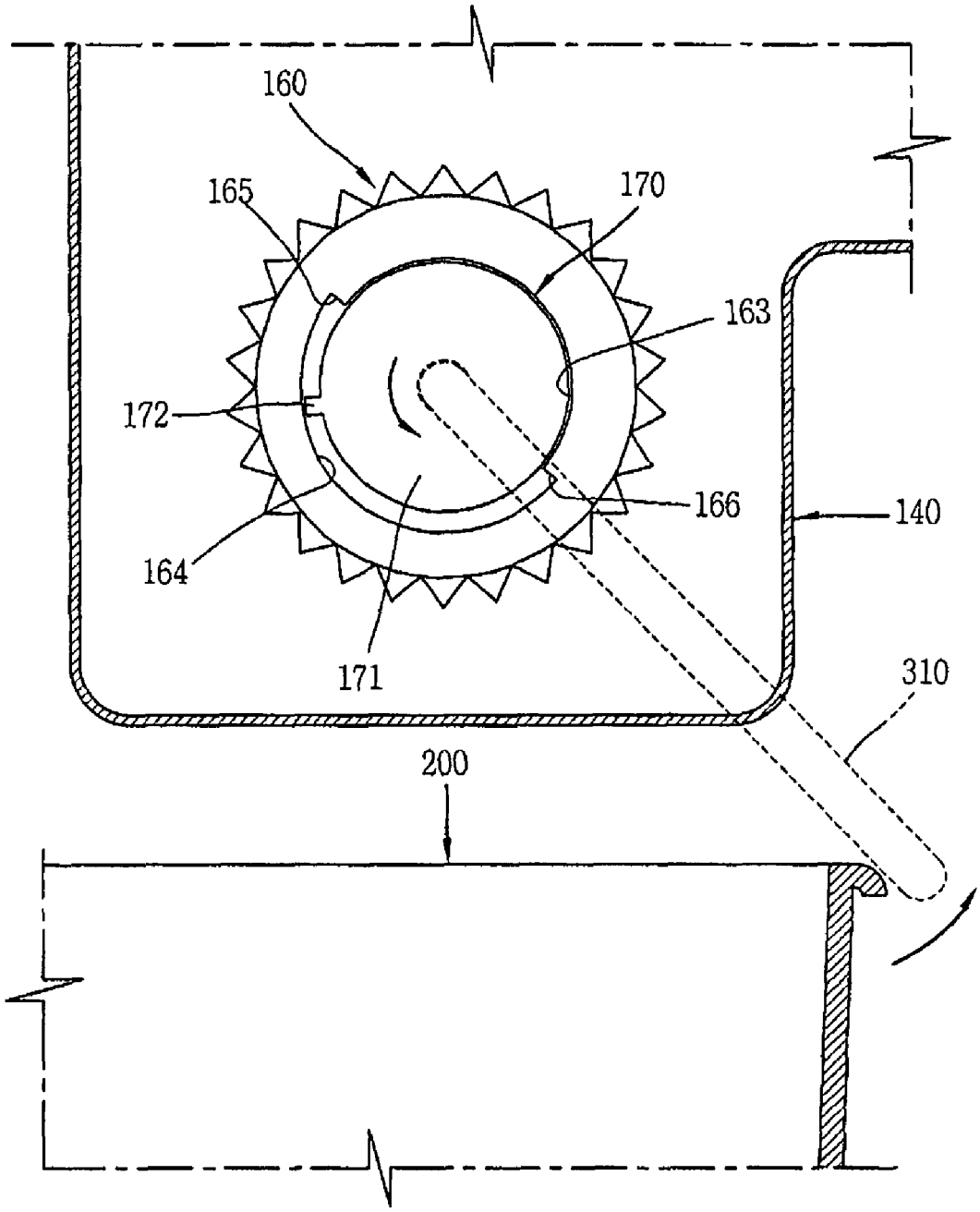

As shown in FIG. 9, under a state that the ice sensing lever 310 is perpendicularly disposed, if the ice bank 200 is pushed into a lower side of the ice maker body 110, the ice bank 200 is locked by the ice sensing lever 310. If an external force is applied to the ice sensing lever 310 while the ice bank 200 is pushed into the lower side of the ice maker body 110, as shown in FIG. 10, the holder 170 of the lever holding unit H to which the ice sensing lever 310 has been coupled receives an elastic force of the torsion spring. Then, the holder 170 of the lever holding unit H is rotated towards the second stepped portion 166. Herein, the gear member 160 is in a fixed state, only the holder 170 is rotated towards the second stepped portion 166 (i.e., performs a relative motion), and the ice sensing lever 310 fixedly-coupled to the holder 170 is angle-rotated.

If the external force applied to the ice sensing lever 310 is released, the holder 170 is rotated towards the first stepped portion 165 by a restoration force of the torsion spring 180.

Since the ice sensing lever 310 is angle-rotated when receiving an external force, the ice sensing lever 310 and the ice bank 200 are prevented from being damaged. Furthermore, the external force applied to the ice sensing lever 310 is prevented from being transmitted to the driving force transmitting unit and the motor M.

If an external force is applied to the ice sensing lever 310 that is in a fixed state, the external force is transmitted to the driving force transmitting unit and the motor M. Accordingly, the components may be separated from the original positions, and a load is supplied to the motor M. Furthermore, if an external force is applied to the ice sensing lever 310 that is in a fixed state, the ice sensing lever 310 and the ice bank 200 may be damaged.

If the ice sensing plate 320 is coupled to the ice sensing lever 310, a contact area of the ice pieces to the ice sensing lever 310 is increased due to the ice sensing plate 320. Accordingly, the amount of the ice pieces stored in the ice bank 200 can be more precisely sensed.

If the ice sensing plate 320 is coupled to the ice sensing lever 310, the ice sensing plate 320 has a wide area thus to easily receive an external force. However, since the ice sensing lever 310 performs a relative motion, the components are prevented from being damaged.

As another embodiment of the present invention, the lever holding unit H can be rotated by an additional driving unit not by the driving force generating unit and the driving force transmitting unit. If an external force is applied to the ice sensing lever 310 when the ice bank 200 is pushed into a lower side of the ice maker body 110, the ice sensing lever 310 is moved. Accordingly, the ice sensing lever 310 and other components are prevented from being damaged.

As aforementioned, in the ice making system for a refrigerator according to the present invention, if an external force is applied to the ice sensing lever that measures an amount of the ice pieces made by the ice maker then to be stored in the ice bank, the ice sensing lever receives an elastic force thus to perform a relative motion. Accordingly, the components are prevented from being damaged, and the product has an enhanced reliability.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An ice making system for a refrigerator, comprising:

an ice maker body;

an ejector rotatably coupled to the ice maker body, that drops ice pieces made by the ice maker body;

an ice bank drawably disposed below the ice maker body, that stores the ice pieces dropped by the ejector;

an ice sensing lever that senses an amount of the ice pieces stored in the ice bank;

a driving force transmitting device that transmits a rotation force received from the ejector to a lever holding device thereby rotating said lever holding device;

wherein the lever holding device elastically supports and couples the ice sensing lever so that the ice sensing lever moves independently from the lever holding device within a preset range when an external force is applied to the ice sensing lever;

said lever holding device comprising:

a holder rotatably coupled to a housing having said driving force transmitting device therein, wherein one side of the ice sensing lever is fixedly coupled to the holder, and the holder comprises a cylindrical portion rotatably inserted into a gear member, a stopping protrusion provided on an outer circumferential surface of the cylindrical portion, and a through hole into which the cylindrical portion is inserted is formed in the gear member, and a guiding groove disposed at an inner circumferential wall of the through hole;

wherein the gear member is coupled to the holder, connected to the driving force transmitting device, rotated by receiving a rotation force from the driving force transmitting device, and the gear rotates the holder and performs a relative motion by a preset angle with respect to the holder and;

an elastic member that elastically connects the holder and the gear member with each other.

2. The ice making system of claim 1, wherein the elastic member comprises a torsion spring.

3. The ice making system of claim 1, wherein the ice sensing lever comprises an ice sensing plate having a predetermined area.

4. The ice making system of claim 3, wherein the ice sensing plate is integrally formed with the ice sensing lever.

5. The ice making system of claim 3, wherein the ice sensing plate is detachably coupled to the ice sensing lever.

6. The ice making system of claim 1, wherein the ice sensing lever comprises a wire having a polygonal shape.

7. The ice making system of claim 6, wherein an ice sensing plate having a predetermined area is coupled to the wire having the polygonal shape.

8. The ice making system of claim 1, wherein the ice sensing lever comprises a polygonal shape and having two supported ends.

9. The ice making system of claim 8, wherein an ice sensing plate having a predetermined area is coupled to the wire having the polygonal shape.

10. The ice making system of claim 1, wherein the guiding groove is formed with a range of approximately 180° in a circumferential direction thereof.

11. The ice making system of claim 1, wherein the guiding groove is provided with a first stepped portion and a second stepped portion at ends thereof.

12. The ice making system of claim 1, wherein a height of the stopping protrusion of the holder corresponds to a depth of the guiding groove of the gear member.

* * * * *